US010703455B2

(12) United States Patent
Shibata et al.

(10) Patent No.: US 10,703,455 B2
(45) Date of Patent: Jul. 7, 2020

(54) JET PROPELLED WATERCRAFT

(71) Applicant: YAMAHA HATSUDOKI KABUSHIKI KAISHA, Iwata-shi, Shizuoka (JP)

(72) Inventors: Masayuki Shibata, Shizuoka (JP); Shusuke Suzuki, Shizuoka (JP); Toshitaka Kouga, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/273,194

(22) Filed: Feb. 12, 2019

(65) Prior Publication Data

US 2020/0039621 A1 Feb. 6, 2020

(30) Foreign Application Priority Data

Jul. 31, 2018 (JP) ..... 2018-143195

(51) Int. Cl.

| | |
|---|---|
| ***B63H 11/00*** | (2006.01) |
| ***B63H 11/08*** | (2006.01) |
| ***B63H 20/00*** | (2006.01) |
| *B63B 3/56* | (2006.01) |
| *B63H 11/11* | (2006.01) |
| *B63B 11/02* | (2006.01) |
| *B63B 17/00* | (2006.01) |

(52) U.S. Cl.

CPC ..... *B63H 11/08* (2013.01); *B63H 21/26* (2013.01); *B63B 3/56* (2013.01); *B63B 11/02* (2013.01); *B63B 17/0081* (2013.01); *B63B 2751/00* (2013.01); *B63H 11/11* (2013.01)

(58) Field of Classification Search

CPC ..... B63B 3/56; B63B 11/02; B63B 17/0081; B63B 19/00; B63B 2019/00; B63B 2751/00; B63H 11/08; B63H 11/11; B63H 21/26; B63H 2011/08

USPC ..... 114/77 R, 78, 116, 173, 177, 382; 440/38, 49, 52, 111, 112

See application file for complete search history.

(56) References Cited

U.S. PATENT DOCUMENTS 4,813,898 A * 3/1989 Nakase ..... B63B 35/731 440/111
5,372,526 A * 12/1994 Ozawa ..... B63H 23/321 440/112
5,695,371 A * 12/1997 Katoh ..... B63H 11/08 440/111

FOREIGN PATENT DOCUMENTS

JP 2000-053074 A 2/2000

* cited by examiner

*Primary Examiner* — Daniel V Venne
(74) *Attorney, Agent, or Firm* — Keating and Bennett, LLP

(57) ABSTRACT

A jet propulsion device is mounted to a vessel body and connected to a drive shaft. A bearing rotatably supports the drive shaft. A bulkhead is disposed inside the vessel body and below a deck. The bulkhead supports the bearing and includes a gap disposed between the drive shaft and the deck. The drive shaft and the gap overlap as seen in a vertical direction.

16 Claims, 13 Drawing Sheets

JET PROPELLED WATERCRAFT

CROSS REFERENCE TO RELATED APPLICATIONS

This application claims the benefit of priority to Japanese Patent Application No. 2018-143195 filed on Jul. 31, 2018. The entire contents of this application are hereby incorporated herein by reference.

BACKGROUND OF THE INVENTION

1. Field of the Invention

The present invention relates to a jet propelled watercraft.

2. Description of the Related Art

A jet propelled watercraft includes a bulkhead for supporting a drive shaft as disclosed in Japan Laid-open Patent Application Publication No. 2000-53074. The bulkhead is disposed inside a vessel body and below a deck. A bearing is attached to the bulkhead in order to support the drive shaft. The bulkhead supports the deck while making contact with the back surface of the deck, and also supports the bearing for supporting the drive shaft.

The jet propelled watercraft has a structure in which vibration from an engine is transferred to the deck through the drive shaft and the bulkhead. This structure is a factor in the increase of noise on the deck.

SUMMARY OF THE INVENTION

Preferred embodiments of the present invention provide reduced noise on the deck of jet propelled watercraft.

A jet propelled watercraft according to a preferred embodiment of the present invention includes a vessel body, an engine, a drive shaft, a jet propulsion device, a bearing, and a bulkhead. The vessel body includes a deck. The engine is mounted to the vessel body. The drive shaft is connected to the engine. The jet propulsion device is mounted to the vessel body, and is connected to the drive shaft. The bearing rotatably supports the drive shaft. The bulkhead is disposed inside the vessel body and below the deck. The bulkhead supports the bearing. The bulkhead includes a gap disposed between the drive shaft and the deck. The drive shaft and the gap overlap as seen in a vertical direction.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
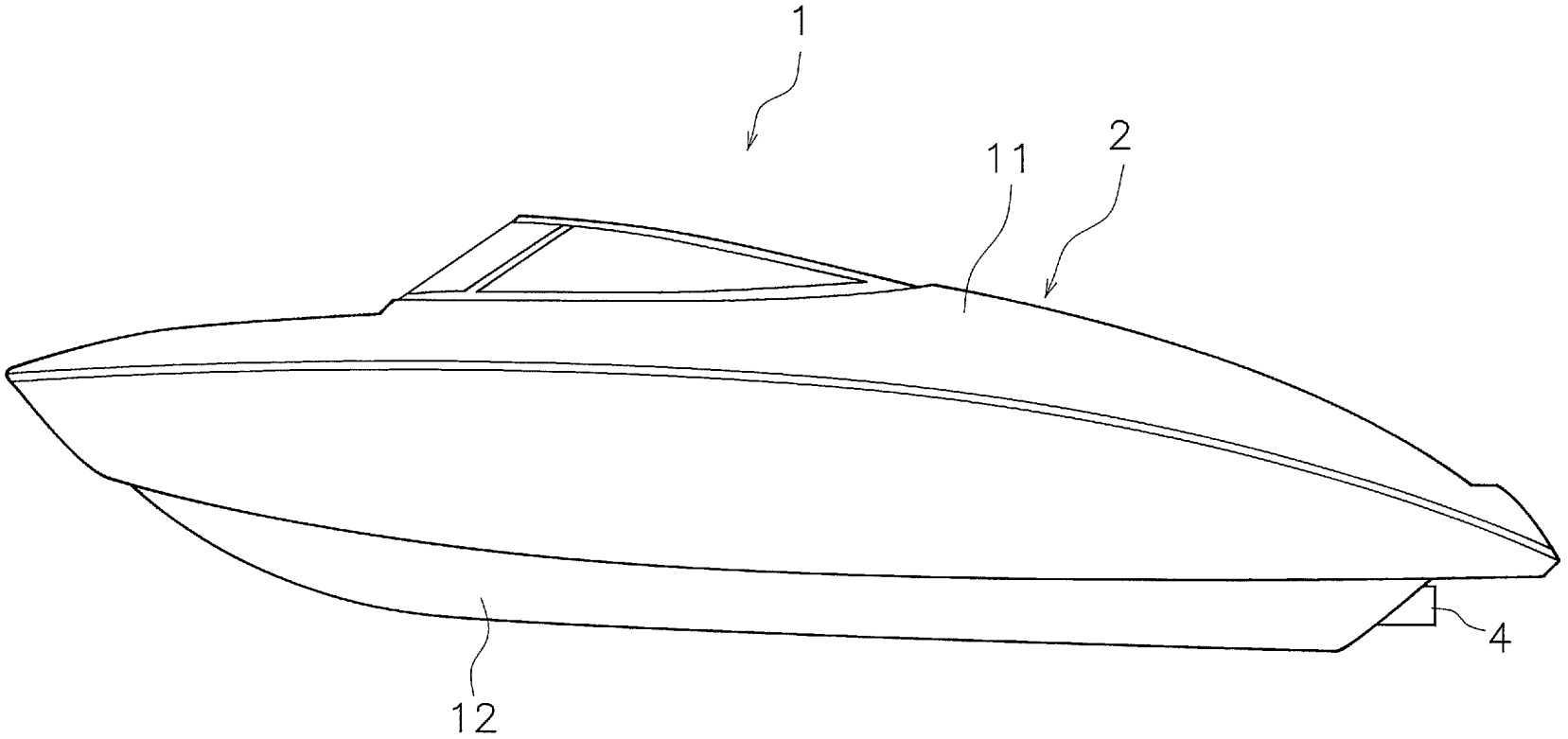
FIG. 1 is a side view of a jet propelled watercraft according to a preferred embodiment of the present invention.
Figure 2:
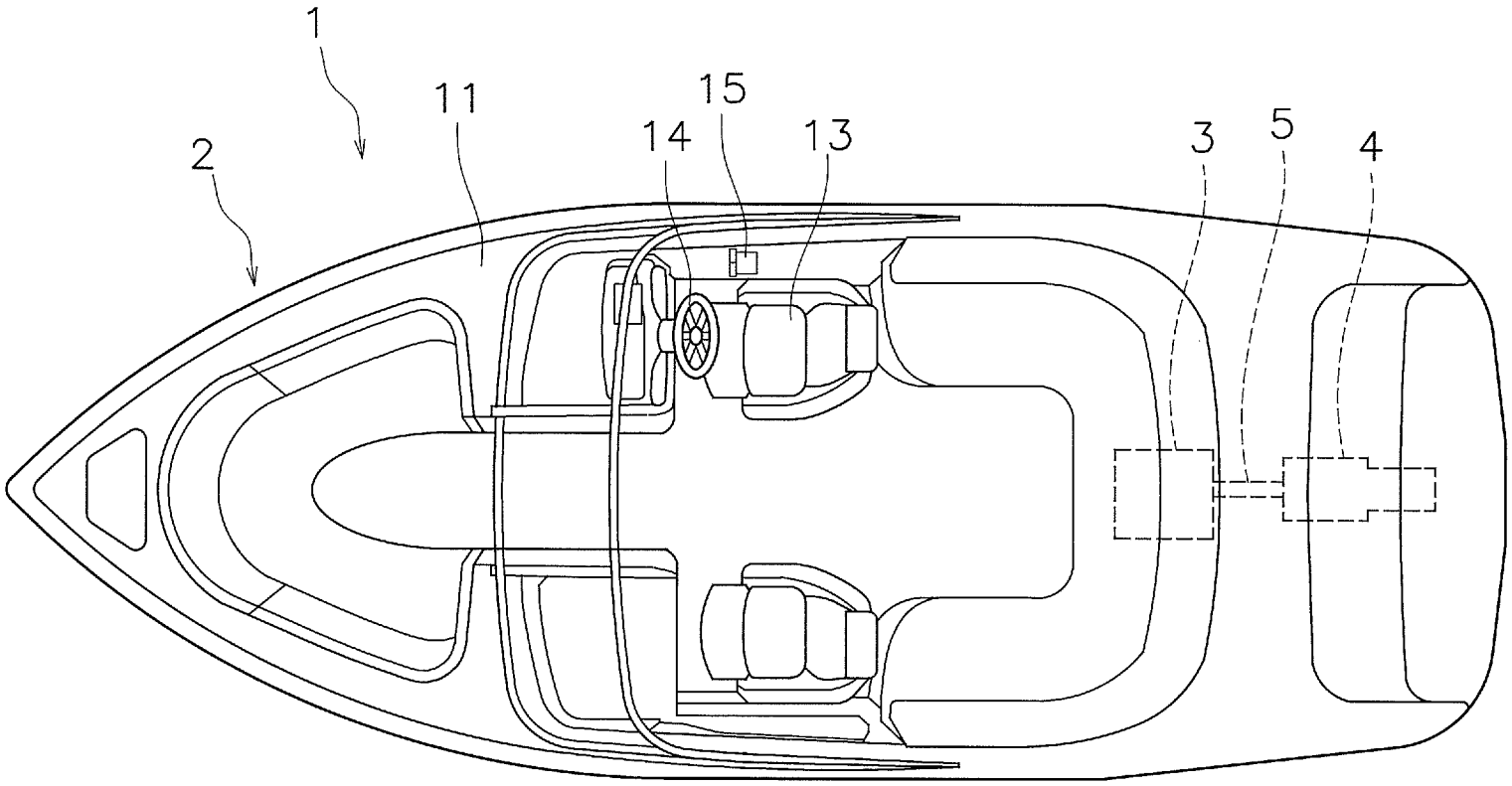
FIG. 2 is a top view of the jet propelled watercraft.

Jet propulsion devices according to preferred embodiments will be hereinafter explained with reference to the drawings. FIG. 1 is a side view of a jet propelled watercraft 1 to which a jet propulsion device according to a preferred embodiment of the present invention is mounted. FIG. 2 is a top view of the jet propelled watercraft 1. In the present preferred embodiment, the jet propelled watercraft 1 is a type of watercraft called a jetboat or a sport boat, for example.

The jet propelled watercraft 1 includes a vessel body 2, an engine 3, a jet propulsion device 4, and a drive shaft 5. The vessel body 2 includes a deck 11 and a hull 12. The hull 12 is disposed below the deck 11. An operator seat 13 is disposed on the deck 11. The operator seat 13 is provided with a steering wheel 14 to steer the jet propelled watercraft 1. Additionally, the operator seat 13 is provided with an operating lever 15 to switch between forward movement and rearward movement of the jet propelled watercraft 1 and to regulate the velocity of the jet propelled watercraft 1.

The engine 3 is accommodated in the vessel body 2. The drive shaft 5 is connected to the engine 3. The drive shaft 5 extends in a back-and-forth direction. The engine 3 is connected to the jet propulsion device 4 through the drive shaft 5. The jet propulsion device 4 is driven by the engine 3 so as to suck in and spout out water surrounding the vessel body 2. Accordingly, the jet propulsion device 4 generates a thrust to move the vessel body 2.

Figure 3:
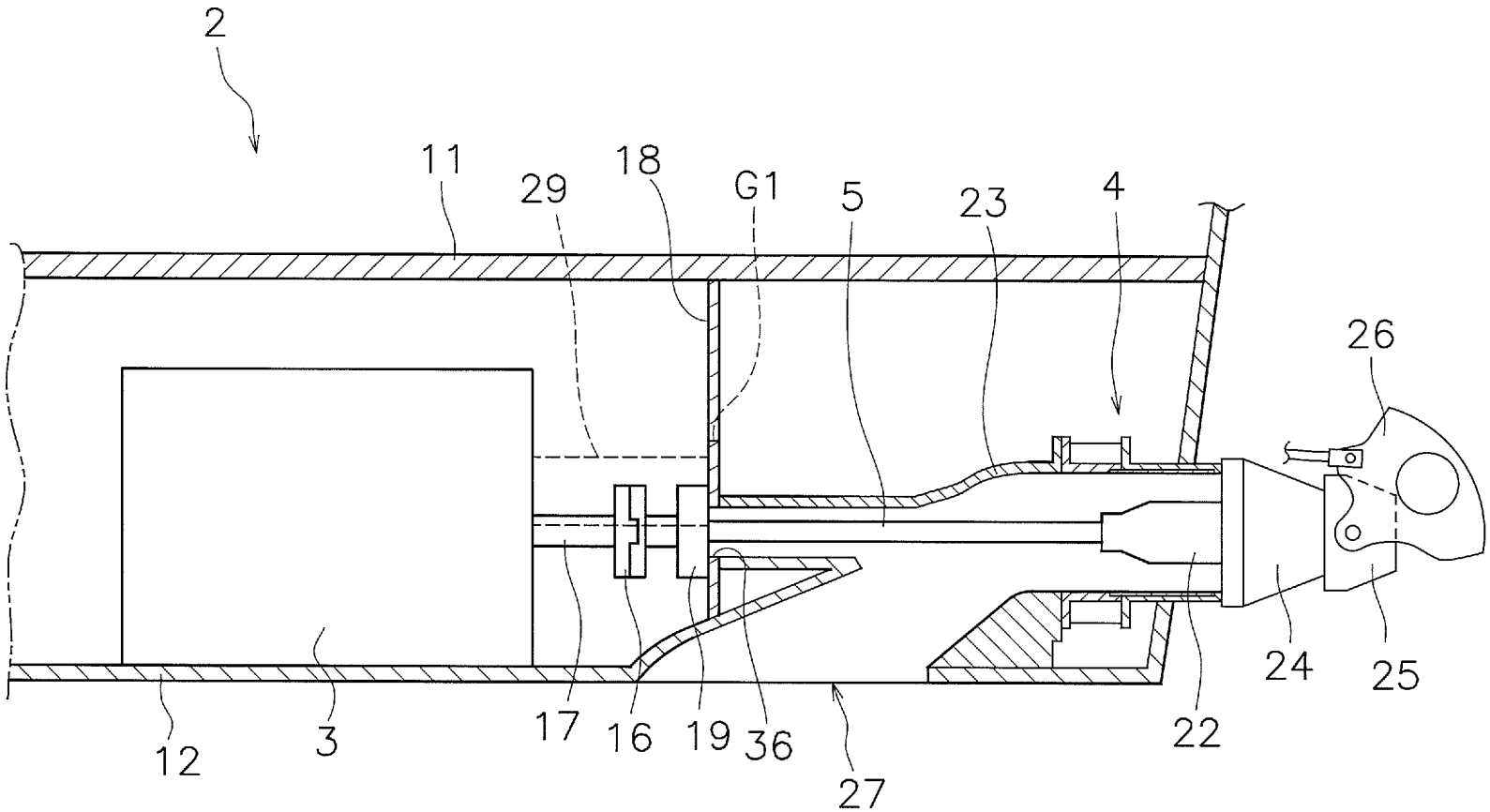
FIG. 3 is a cross-sectional side view of a partial configuration of the jet propelled watercraft.

FIG. 3 is a side view of a configuration inside the vessel body 2. It should be noted that FIG. 3 shows a portion of the jet propulsion device 4 in a cross-sectional representation. As shown in FIG. 3, the drive shaft 5 is connected to an output shaft 17 of the engine 3 through a coupling 16. A bulkhead 18 and a bearing 19 are disposed inside the vessel body 2. The bearing 19 rotatably supports the drive shaft 5. The bearing 19 is attached to the bulkhead 18. The bulkhead 18 is disposed inside the vessel body 2 and below the deck 11. The bulkhead 18 supports the bearing 19.

The jet propulsion device 4 includes an impeller 22, an impeller housing 23, a nozzle 24, a deflector 25, and a reverse bucket 26. The impeller 22 is connected to the drive shaft 5. The impeller 22 is disposed inside the impeller housing 23. The impeller 22 is rotated together with the drive shaft 5 in order to draw water through a water suction port 27. The impeller 22 rearwardly spouts the drawn in water through the nozzle 24.

The deflector 25 is disposed behind the nozzle 24. The reverse bucket 26 is disposed behind the deflector 25. The deflector 25 is able to turn the direction of water spouted through the nozzle 24 to a right-and-left direction. A position of the reverse bucket 26 is switchable between a forward moving position and a rearward moving position. When the position of the reverse bucket 26 is switched between the forward moving position and the rearward moving position, the direction of the water spouted through the nozzle 24 is changed. Movement of the jet propelled watercraft 1 is thus switched between forward movement and rearward movement.

Figure 4:
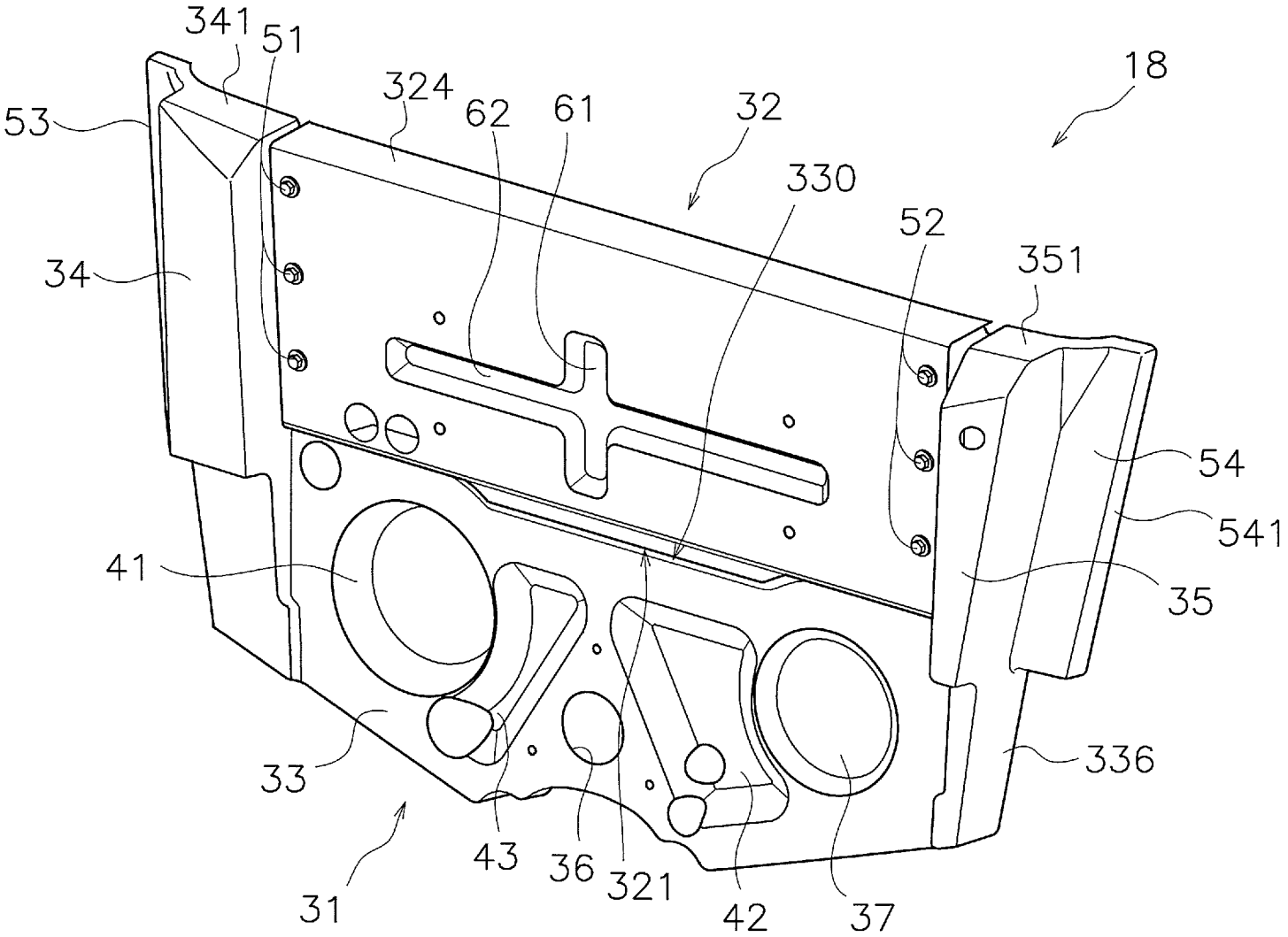
FIG. 4 is a perspective view of a bulkhead.
Figure 5:
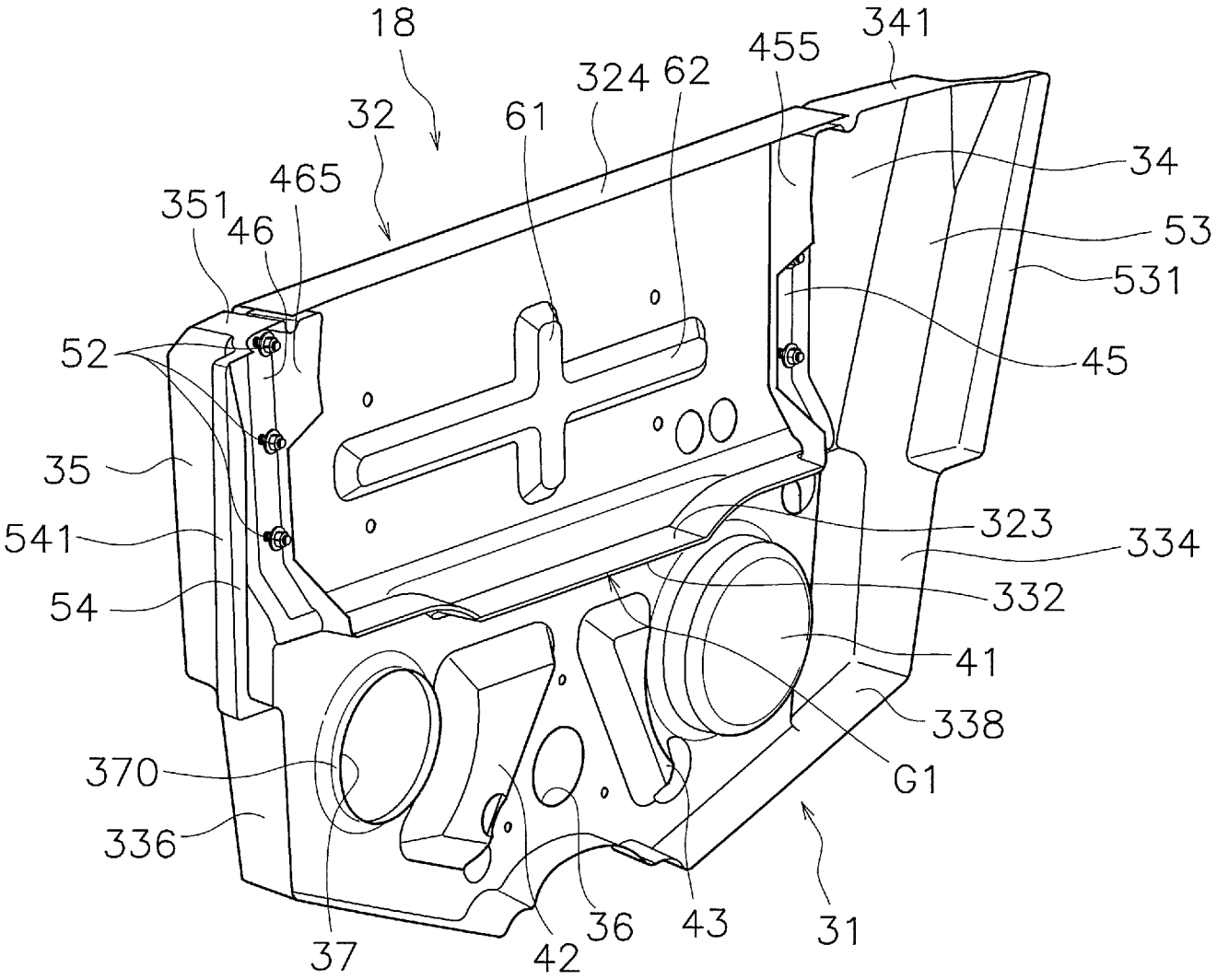
FIG. 5 is a perspective view of the bulkhead.
Figure 6:
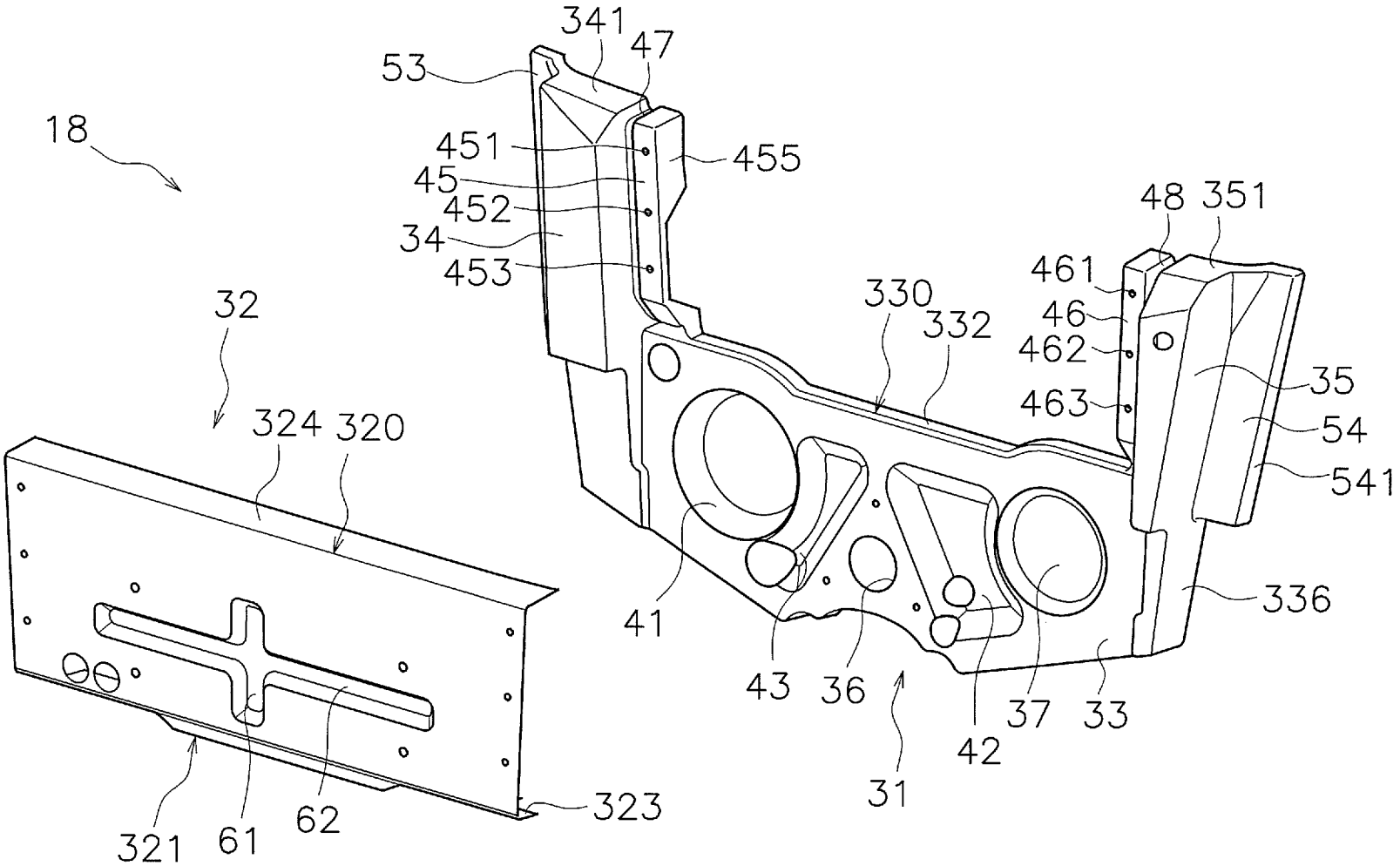
FIG. 6 is an exploded perspective view of the bulkhead.
Figure 7:
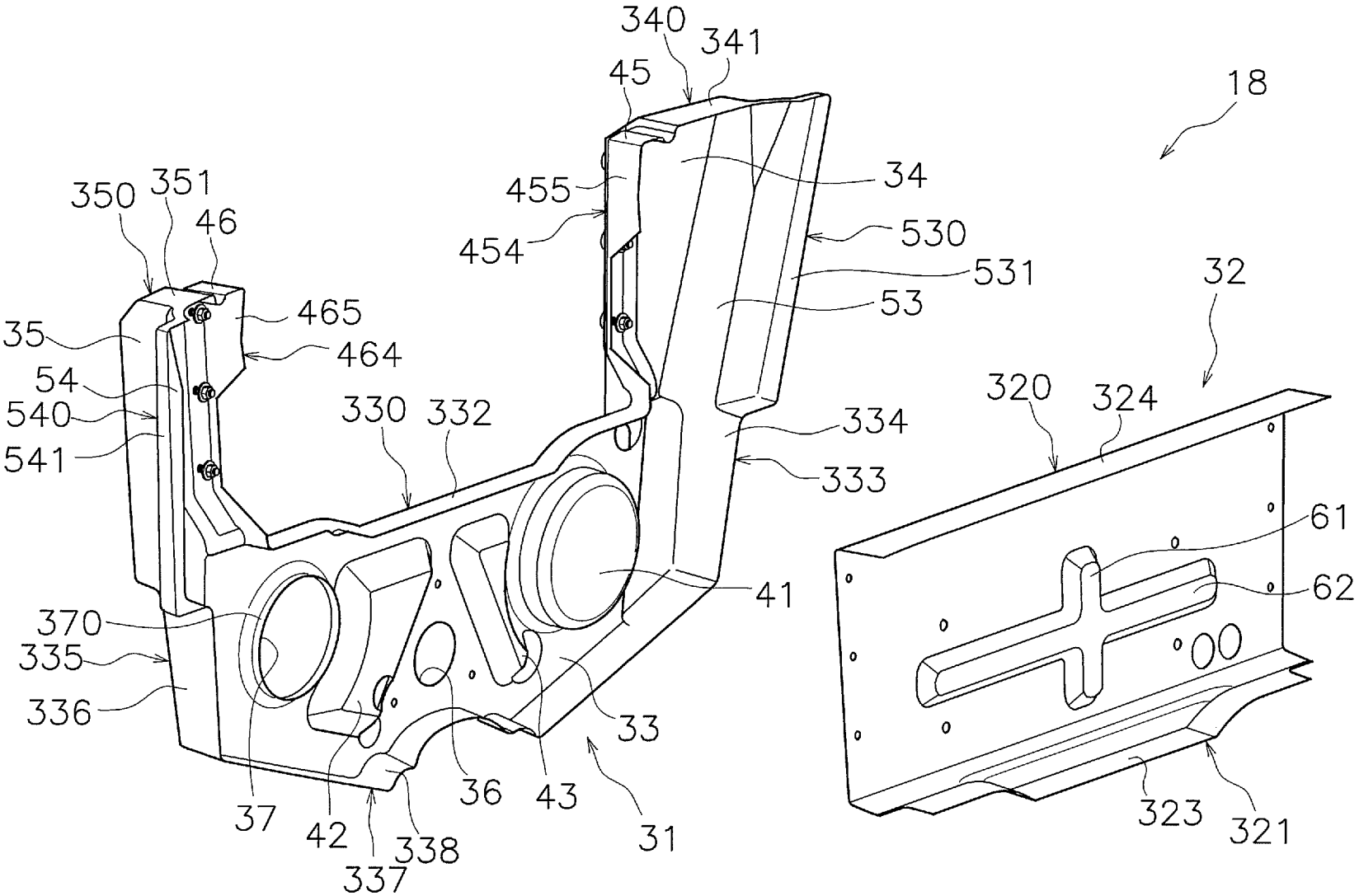
FIG. 7 is an exploded perspective view of the bulkhead.
Figure 8:
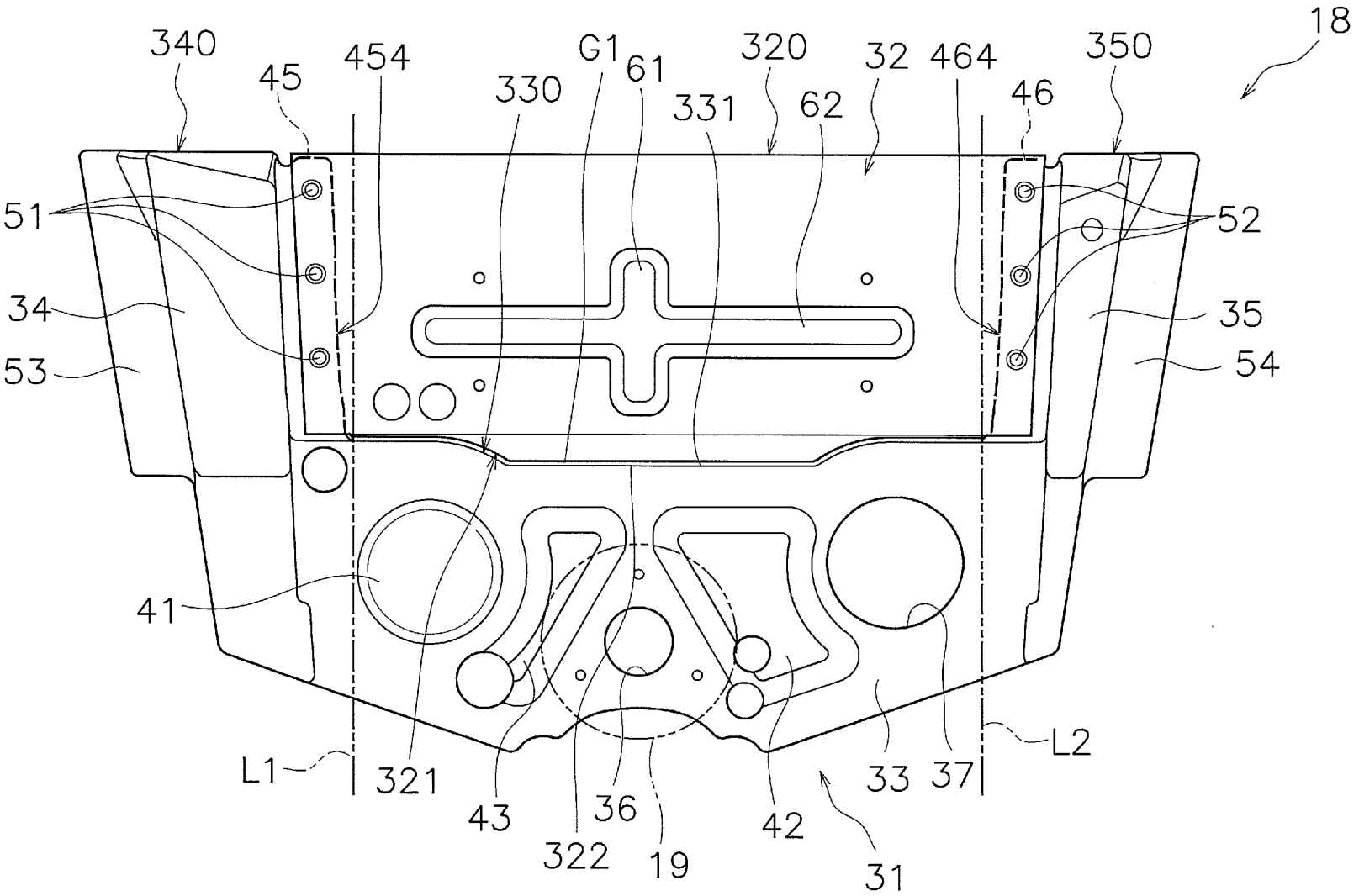
FIG. 8 is a rear view of the bulkhead.

Next, the structure of the bulkhead 18 will be explained in detail. It should be noted that in the following explanation, front, rear, right, left, up, and down directions are defined as corresponding to the front, rear, right, left, up, and down directions based on a condition that the bulkhead 18 is attached to the jet propelled watercraft 1, respectively. FIGS. 4 and 5 are perspective views of the bulkhead 18. FIGS. 6 and 7 are exploded perspective views of the bulkhead 18. FIG. 8 is a rear view of the bulkhead 18.

As shown in FIGS. 4 to 8, the bulkhead 18 includes a first member 31 and a second member 32. The first and second members 31 and 32 are provided separately from each other. The first member 31 is disposed at least partially below the second member 32. The second member 32 is attached to the first member 31. Each of the first and second members 31 and 32 is preferably made of bent sheet metal, for example.

Each of the first and second members 31 and 32 is made by, for instance, stamping. However, each of the first and second members 31 and 32 may be made by joining a plurality of members by, for example, welding or the like. Alternatively, each of the first and second members 31 and 32 may be a cast product or a molded resin product.

Figure 9:
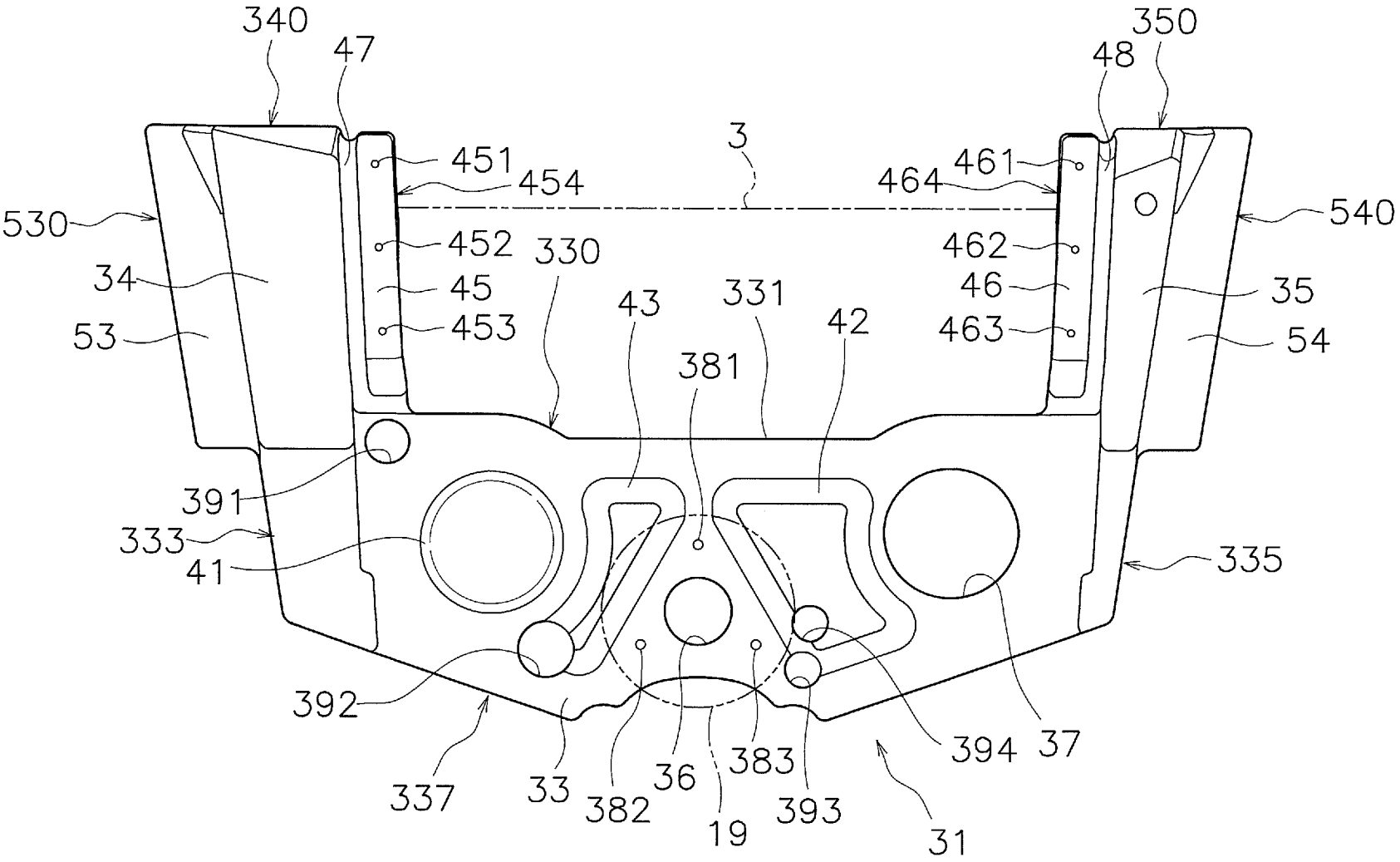
FIG. 9 is a rear view of a first member of the bulkhead.

FIG. 9 is a rear view of the first member 31. As shown in FIG. 9, the first member 31 includes a main body 33, a left upper portion 34, and a right upper portion 35. The main body 33 is disposed below the second member 32. The left upper portion 34 and the right upper portion 35 are connected to the main body 33. It should be noted that in the present specification, the term "connection" is not limited to a condition that separate members are fixed to each other, and encompasses a condition that a plurality of portions are an integrated member that are continuous with each other. The left upper portion 34 and the right upper portion 35 extend upwardly from the main body 33.

The main body 33 includes a shaft hole 36 and a communication hole 37. The drive shaft 5 is inserted through the shaft hole 36. The bearing 19 is attached to the shaft hole 36. More specifically, as shown in FIG. 9, the main body 33 includes a plurality of attachment holes 381 to 383 located around the shaft hole 36. The bearing 19 is fixed to the main body 33 by fasteners (not shown in the drawings) such as bolts inserted through the attachment holes 381 to 383, respectively.

The communication hole 37 is preferably disposed laterally of the shaft hole 36. As shown in FIG. 3, an exhaust pipe 29 is connected to the engine 3. The exhaust pipe 29 is inserted through the communication hole 37. The diameter of the communication hole 37 is preferably larger than that of the shaft hole 36. Additionally, as shown in FIG. 9, the main body 33 includes a plurality of holes 391 to 394. Harnesses or bilge hoses, for example, are inserted through the plurality of holes 391 to 394.

As shown in FIG. 5, the communication hole 37 is provided with a flange 370 on the edge thereof. The flange 370 of the communication hole 37 protrudes from the main body 33 in the back-and-forth direction. The flange 370 enhances the stiffness of the communication hole 37.

The main body 33 preferably has a protruding and recessed shape. The main body 33 includes a tubular protrusion 41. The tubular protrusion 41 protrudes in the back-and-forth direction. The diameter of the tubular protrusion 41 is preferably larger than that of the shaft hole 36. The tubular protrusion 41 is preferably disposed laterally of the shaft hole 36. The communication hole 37 is preferably disposed rightward (or leftward) of the shaft hole 36, whereas the tubular protrusion 41 is preferably disposed leftward (or rightward) of the shaft hole 36. In other words, the shaft hole 36 is preferably disposed between the tubular protrusion 41 and the communication hole 37.

The main body 33 further includes a first lower protrusion 42 and a second lower protrusion 43. The first and second lower protrusions 42 and 43 protrude in the back-and-forth direction. The first lower protrusion 42 is preferably disposed between the shaft hole 36 and the communication hole 37. The second lower protrusion 43 is preferably disposed between the shaft hole 36 and the tubular protrusion 41.

The left upper portion 34 is preferably disposed leftward of the second member 32. The left upper portion 34 extends farther upward than an upper edge 330 of the main body 33. The right upper portion 35 is preferably disposed rightward of the second member 32. The right upper portion 35 extends farther upward than the upper edge 330 of the main body 33.

The first member 31 includes a first left attachment portion 45 and a first right attachment portion 46. The first left attachment portion 45 is preferably disposed on an inner lateral side of the left upper portion 34. As seen in the back-and-forth direction, the first left attachment portion 45 overlaps the second member 32. A recessed groove 47 is provided between the first left attachment portion 45 and the left upper portion 34. The second member 32 is fixed to the first left attachment portion 45. The first left attachment portion 45 includes a plurality of holes 451 to 453. The plurality of holes 451 to 453 are aligned in an up-and-down direction. The second member 32 is fixed to the first left attachment portion 45 by fasteners 51 (see FIG. 8) such as bolts inserted through the plurality of holes 451 to 453, respectively.

The first right attachment portion 46 is preferably disposed on an inner lateral side of the right upper portion 35. As seen in the back-and-forth direction, the first right attachment portion 46 overlaps the second member 32. A recessed groove 48 is provided between the first right attachment portion 46 and the right upper portion 35. The second member 32 is fixed to the first right attachment portion 46. The first right attachment portion 46 includes a plurality of holes 461 to 463. The plurality of holes 461 to 463 are aligned in the up-and-down direction. The second member 32 is fixed to the first right attachment portion 46 by fasteners 52 (see FIG. 8) such as bolts inserted through the plurality of holes 461 to 463, respectively.

The first member 31 includes a left extension 53 and a right extension 54. The left extension 53 is disposed laterally outward (i.e., leftward) of the left upper portion 34. The left extension 53 protrudes farther leftward than the main body 33. The right extension 54 is disposed laterally outward (i.e., rightward) of the right upper portion 35. The right extension 54 protrudes farther rightward than the main body 33.

The second member 32 is disposed above the main body 33, and between the left upper portion 34 and the right upper portion 35 in the right-and-left direction. The second member 32 is detachably attached to the first member 31. As seen in the rear view, the second member 32 overlaps at least a portion of the engine 3. Therefore, as shown in the rear view of FIG. 9, the engine 3 is at least partially visible when the first member 31 is detached from the second member 32.

Figure 10:
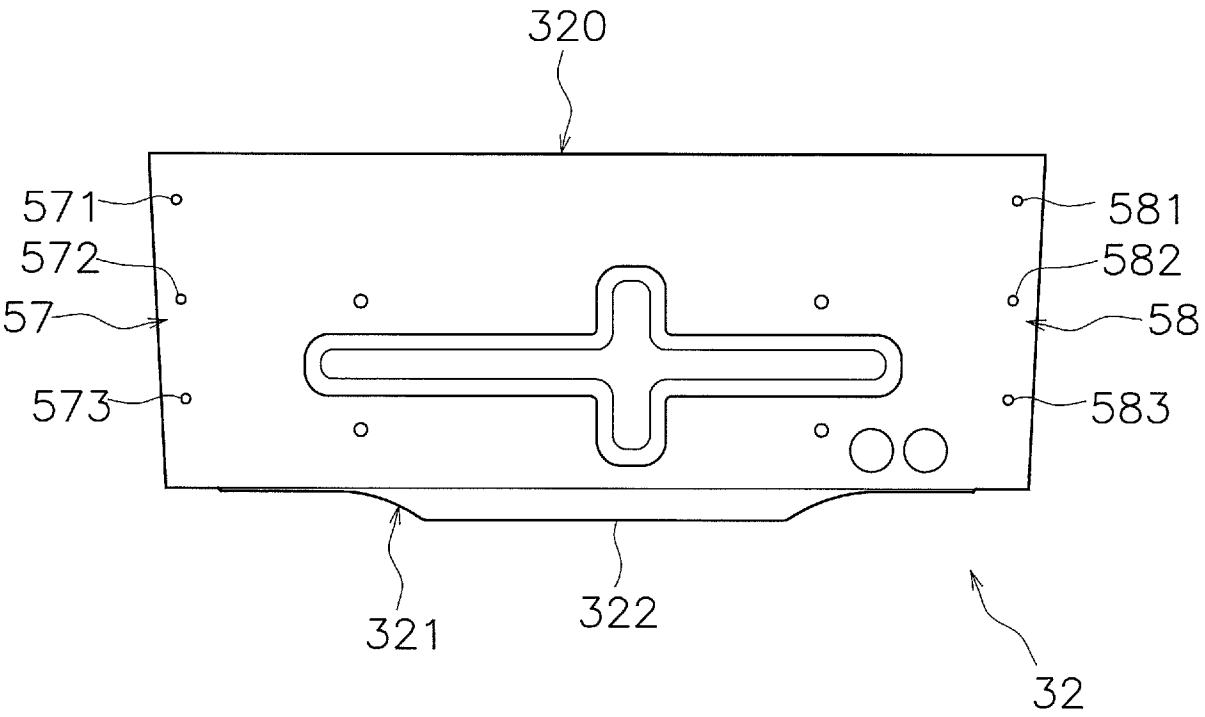
FIG. 10 is a rear view of a second member of the bulkhead.

FIG. 10 is a rear view of the second member 32. As shown in FIG. 10, the second member 32 includes a second left attachment portion 57 and a second right attachment portion 58. The second left attachment portion 57 is provided in a left lateral portion of the second member 32. As seen in the back-and-forth direction, the second left attachment portion 57 overlaps the first left attachment portion 45 of the first member 31. The second left attachment portion 57 includes a plurality of attachment holes 571 to 573. The plurality of attachment holes 571 to 573 are aligned in the up-and-down direction. The second left attachment portion 57 is detachably fixed to the first left attachment portion 45 by inserting the fasteners 51 (see FIG. 8) through the plurality of attachment holes 571 to 573, respectively.

The second right attachment portion 58 is provided in a right lateral portion of the second member 32. As seen in the back-and-forth direction, the second right attachment portion 58 overlaps the first right attachment portion 46 of the first member 31. The second right attachment portion 58 includes a plurality of attachment holes 581 to 583. The plurality of attachment holes 581 to 583 are aligned in the up-and-down direction. The second right attachment portion 58 is detachably fixed to the first right attachment portion 46 by inserting the fasteners 52 (see FIG. 8) through the plurality of attachment holes 581 to 583, respectively.

An upper edge 320 of the second member 32 extends in the right-and-left direction. As shown in FIG. 8, the upper edge 320 of the second member 32 is flush or substantially flush with an upper edge 340 of the left upper portion 34 and an upper edge 350 of the right upper portion 35. A lower edge 321 of the second member 32 extends in the right-and-left direction. The lower edge 321 of the second member 32 opposes the upper edge 330 of the main body 33 of the first member 31. The upper edge 330 of the main body 33 extends in the right-and-left direction. The upper edge 330 includes a recessed portion 331 that is recessed downward. The lower edge 321 of the second member 32 includes a protrusion 322 that protrudes downward. The protrusion 322 has a shape that fits into the recessed portion 331.

Figure 11:
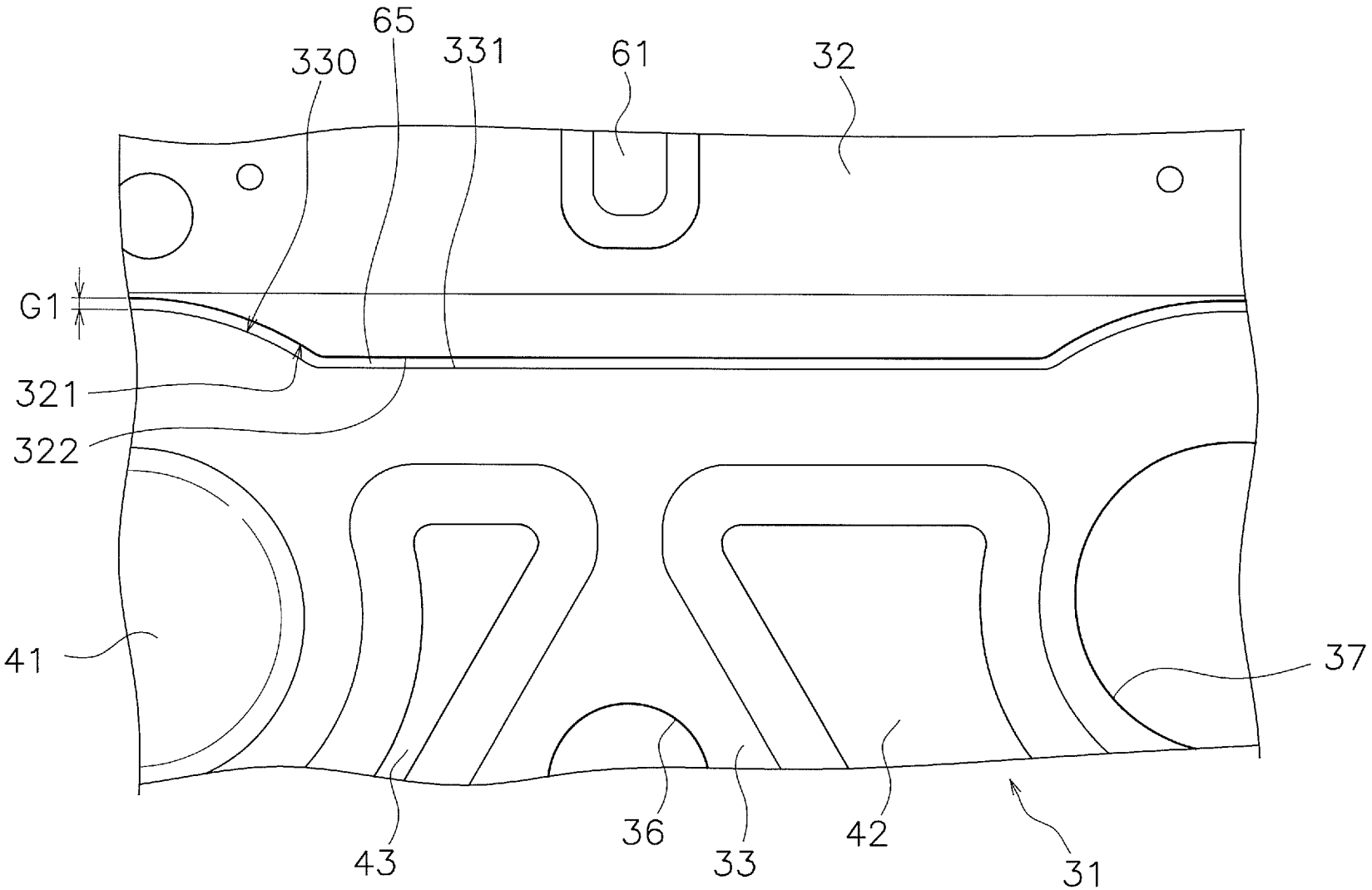
FIG. 11 is an enlarged rear view of the bulkhead.

FIG. 11 is an enlarged rear view of the bulkhead 18. As shown in FIG. 11, the bulkhead 18 includes a gap G1 extending in the right-and-left direction. The gap G1 is disposed above the shaft hole 36 in the bulkhead 18. As shown in FIG. 3, the gap G1 is disposed between the drive shaft 5 and the deck 11 in the vertical direction.

A vibration absorption material 65 is disposed in the gap G1. The vibration absorption material 65 is made of resin, for instance, urethane foam or the like. However, the vibration absorption material 65 may be made of any suitable material other than a resin.

Figure 12:
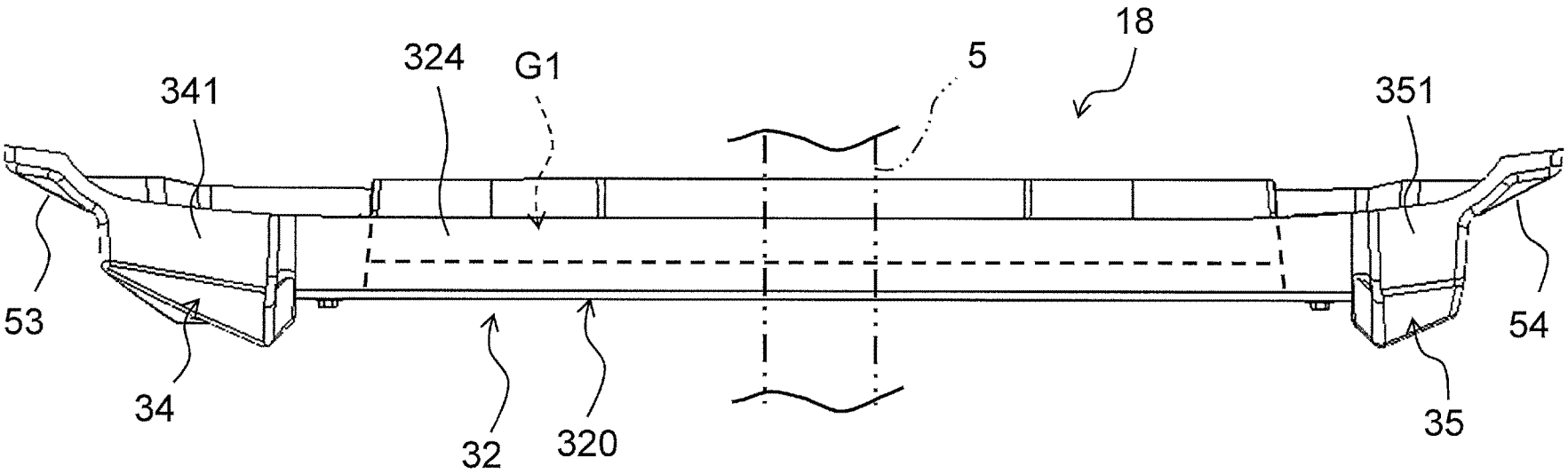
FIG. 12 is a top view of the bulkhead.

FIG. 12 is a top view of the bulkhead 18. In FIG. 12, the dashed two-dotted line indicates the position of the drive shaft 5. As shown in FIG. 12, when seen in the vertical direction, the drive shaft 5 overlaps the gap G1.

As shown in FIG. 11, in the present preferred embodiment, the gap G1 is located between the first member 31 and the second member 32. More specifically, the gap G1 is located between the upper edge 330 of the main body 33 and the lower edge 321 of the second member 32. The gap G1 is located along the protrusion 322 of the second member 32 and the recessed portion 331 of the first member 31.

As shown in FIG. 8, the gap G1 has a shape that is more elongated in the right-and-left direction than in the vertical direction. The gap G1 extends between an inner lateral edge 454 of the first left attachment portion 45 and an inner lateral edge 464 of the first right attachment portion 46. The gap G1 is preferably larger than the shaft hole 36 in the right-and-left direction. The gap G1 is preferably larger than the communication hole 37 in the right-and-left direction. The gap G1 is preferably larger than the outer diameter of the bearing 19 in the right-and-left direction.

As shown in FIG. 8, a region located between a first imaginary line L1 and a second imaginary line L2 as seen in the back-and-forth direction is defined as the region of the gap G1. The first imaginary line L1 extends in the vertical direction and passes through the left end of the gap G1. The second imaginary line L2 extends in the vertical direction and passes through the right end of the gap G1. As shown in FIG. 8, when seen in the back-and-forth direction, the range of the gap G1 overlaps the shaft hole 36 and the communication hole 37. When seen in the back-and-forth direction, the range of the gap G1 overlaps the bearing 19.

As shown in FIG. 5, the bulkhead 18 includes flanges 332 and 323 provided along the edge of the gap G1. More specifically, as shown in FIG. 7, the flange 332 is provided along the upper edge 330 of the main body 33 of the first member 31. On the other hand, the flange 323 is provided along the lower edge 321 of the second member 32.

Additionally, a flange 455 is provided along the inner lateral edge 454 of the first left attachment portion 45. A flange 465 is provided along the inner lateral edge 464 of the first right attachment portion 46. A flange 341 is provided along the upper edge 340 of the left upper portion 34. A flange 351 is provided along the upper edge 350 of the right upper portion 35. A flange 531 is provided along a left lateral edge 530 of the left extension 53. A flange 541 is provided along a right lateral edge 540 of the right extension 54.

A flange 334 is provided along a left lateral edge 333 of the main body 33. A flange 336 is provided along a right lateral edge 335 of the main body 33. A flange 338 is provided along a lower edge 337 of the main body 33. A flange 324 is provided along the upper edge 320 of the second member 32.

The bulkhead 18 preferably has a protruding and recessed shape in a portion thereof that is disposed between the drive shaft 5 and the deck 11 in the vertical direction. More specifically, the second member 32 includes a first protrusion 61 and a second protrusion 62. The first protrusion 61 extends in the up-and-down direction. The second protrusion 62 extends in the right-and-left direction. The first and second protrusions 61 and 62 overlap each other in the vicinity of the middle portion of the second member 32 in the right-and-left direction. As shown in FIG. 8, when seen in the back-and-forth direction, the overlapped portions of the first and second protrusions 61 and 62 overlap the region of the gap G1. When seen in the back-and-forth direction, the first protrusion 61 overlaps the region of the gap G1. When seen in the back-and-forth direction, the second protrusion 62 overlaps the region of the gap G1.

In the jet propelled watercraft according to a preferred embodiment of the present invention, the bulkhead 18 includes the gap G1 disposed between the drive shaft 5 and the deck 11. Additionally, as seen in the vertical direction, the drive shaft 5 and the gap G1 overlap each other. Therefore, it is possible to reduce vibration transferred from the drive shaft 5 to the deck 11 through the bulkhead 18 with the gap G1. Because of this, it is possible to reduce noise on the deck 11.

The bulkhead 18 includes the protruding and recessed shape in the portion thereof that is disposed between the drive shaft 5 and the deck 11 in the vertical direction. Because of this, the bulkhead 18 has an enhanced stiffness.

The bulkhead 18 includes the flanges 323 and 332 provided along the edge of the gap G1. Because of this, the portions along the edge of gap G1 have an enhanced stiffness.

The second member 32 is detachably attached to the first member 31 in the bulkhead 18. Additionally, as seen in the rear view, the engine 3 is at least partially visible when the first member 31 is detached from the second member 32. Because of this, maintenance performance is enhanced.

Preferred embodiments of the present invention have been explained above. However, the present invention is not limited to the above-described preferred embodiments, and a variety of changes can be made without departing from the gist of the present invention.

In the above-described preferred embodiments, the jet propulsion device is preferably mounted to the jetboat. However, the jet propulsion device may be mounted to another type of jet propelled watercraft such as a PWC (Personal Watercraft) or the like. The number of jet propulsion devices mounted to the jet propelled watercraft is not limited one, and alternatively, may be two or more.

Figure 13:
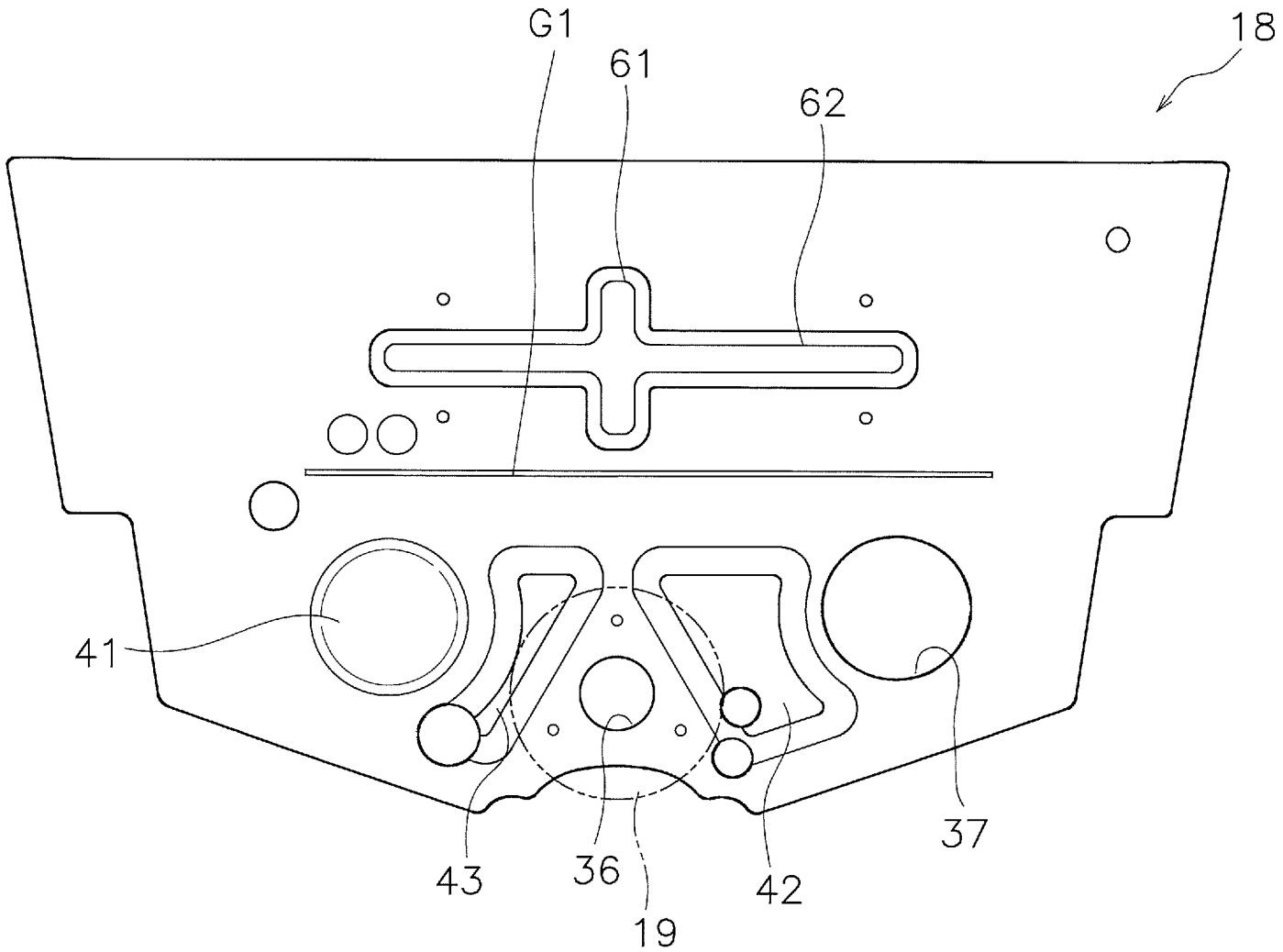
FIG. 13 is a rear view of a bulkhead according to a modified preferred embodiment of the present invention.

The shape of the bulkhead 18 may not be limited to that in the above-described preferred embodiments, and may be changed. The first and second members 31 and 32 may not be separate from each other, and alternatively, may be integral and unitary with each other. For example, as shown in FIG. 13, the bulkhead 18 may be an integrated component, and may be provided with the gap G1.

The shape of the first member 31 may not be limited to that in the above-described preferred embodiments, and may be changed. The shape of the second member 32 may not be limited to that in the above-described preferred embodiments, and may be changed. The shape and/or layout of the gap G1 may not be limited to those or that in the above-described preferred embodiments, and may be changed. For example, the length of the gap G1 in the right-and-left direction may be longer than that in the above-described preferred embodiments. Alternatively, the length of the gap G1 in the right-and-left direction may be shorter than that in the above-described preferred embodiments.

The shape and/or layout of the protruding and recessed portion of the bulkhead 18 may not be limited to those or that in the above-described preferred embodiments, and may be changed. For example, the first and second protrusions 61 and 62 of the second member 32 may be disposed apart from each other. Alternatively, either or both of the first and second protrusions 61 and 62 may be omitted. The vibration absorption material 65, disposed in the gap G1, may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:
a vessel body including a deck;
an engine mounted to the vessel body;
a drive shaft connected to the engine;
a jet propulsion device mounted to the vessel body and connected to the drive shaft;
a bearing that rotatably supports the drive shaft; and
a bulkhead disposed inside the vessel body and below the deck, the bulkhead supporting the bearing and including a gap between the drive shaft and the deck; wherein
the bulkhead includes a shaft hole through which the drive shaft extends;
the gap is separate and spaced away from the shaft hole; and
the drive shaft and the gap overlap as seen in a vertical direction of the vessel body.

2. The jet propelled watercraft according to claim 1, wherein
the bearing is attached to the shaft hole; and
the gap is larger than the shaft hole in a right-and-left direction of the vessel body.

3. The jet propelled watercraft according to claim 1, further comprising:
an exhaust pipe connected to the engine; wherein
the bulkhead includes a communication hole through which the exhaust pipe extends; and
the gap is larger than the communication hole in a right-and-left direction of the vessel body.

4. The jet propelled watercraft according to claim 1, further comprising:
an exhaust pipe connected to the engine; wherein
the bulkhead includes the shaft hole to which the bearing is attached and a communication hole through which the exhaust pipe extends;
a region located between a first imaginary line and a second imaginary line as seen in a back-and-forth direction of the vessel body is defined as a range of the gap, the first imaginary line extends in the vertical direction and passes through a left end of the gap, and the second imaginary line extends in the vertical direction and passes through a right end of the gap; and
the range of the gap overlaps the shaft hole and the communication hole as seen in the back-and-forth direction of the vessel body.

5. The jet propelled watercraft according to claim 1, wherein the gap has a shape that is more elongated in a right-and-left direction than in the vertical direction.

6. The jet propelled watercraft according to claim 1, wherein the bulkhead includes a protruding and recessed portion disposed between the drive shaft and the deck in the vertical direction.

7. The jet propelled watercraft according to claim 1, wherein the bulkhead includes a flange extending along an edge of the gap.

8. The jet propelled watercraft according to claim 1, wherein
the bulkhead includes:
a first member; and
a second member provided separately from the first member, the second member being disposed between the deck and at least a portion of the first member, the second member being attached to the first member; wherein
the gap is located between the first member and the second member.

9. The jet propelled watercraft according to claim 8, wherein
the first member includes a main body located below the second member; and
the gap is located between an upper edge of the main body and a lower edge of the second member.

10. The jet propelled watercraft according to claim 9, wherein
the lower edge of the second member includes a protruding portion that protrudes downward; and
the gap is located along the protruding portion.

11. The jet propelled watercraft according to claim 8, wherein the first member includes:
a main body located below the second member;
a left upper portion that extends upwardly from the main body and is located leftward of the second member; and
a right upper portion that extends upwardly from the main body and is located rightward of the second member.

12. The jet propelled watercraft according to claim 11, wherein the second member includes:
a left attachment portion provided in a left lateral portion of the second member and fixed to the first member; and a right attachment portion provided in a right lateral portion of the second member and fixed to the first member.

13. The jet propelled watercraft according to claim 8, wherein the second member includes:

a first protrusion extending in an up-and-down direction; and a second protrusion extending in a right-and-left direction.

14. The jet propelled watercraft according to claim 13, wherein the first protrusion and the second protrusion overlap each other in a middle portion of the second member as seen in the vertical direction.

15. The jet propelled watercraft according to claim 14, wherein a region located between a first imaginary line and a second imaginary line as seen in a back-and-forth direction of the vessel body is defined as a range of the gap, the first imaginary line extends in the vertical direction and passes through a left end of the gap, and the second imaginary line extends in the vertical direction and passes through a right end of the gap; and overlapping portions of the first protrusion and the second protrusion overlap the range of the gap as seen in the back-and-forth direction of the vessel body.

16. The jet propelled watercraft according to claim 8, wherein the second member is detachably attached to the first member; and the engine is at least partially visible as seen in a rear view of the vessel body when the second member is detached from the first member.

* * * * *